US005494304A

United States Patent [19]

Levy et al.

[11] Patent Number: 5,494,304

[45] **Date of Patent: * Feb. 27, 1996**

[54] VARIABLE GEOMETRY ROLLER SKATES

[76] Inventors: Richard C. Levy, P. O. Box 34828, Bethesda, Md. 20827; Richard J. Maddocks, 302 Lexington Dr., Silver Spring, Md. 20901

[ * ] Notice: The portion of the term of this patent subsequent to Dec. 13, 2011, has been disclaimed.

[21] Appl. No.: 282,436

[22] Filed: Jul. 29, 1994

Related U.S. Application Data

[63] Continuation-in-part of Ser. No. 986,564, Dec. 7, 1992, Pat. No. 5,372,534.

[51] Int. Cl.[6] ..... A63C 17/04

[52] U.S. Cl. ..... 280/11.22

[58] Field of Search ..... 280/11.22, 11.26, 280/11.27, 11.19, 43.17; 180/209, 906; 446/469, 465, 457

[56] References Cited

U.S. PATENT DOCUMENTS

| | | | |
|---|---|---|---|
| 280,236 | 6/1883 | Phillips | 280/11.19 |
| 561,798 | 6/1896 | Lawson | 280/239 X |
| 601,231 | 3/1898 | Blackburn | 280/47.11 |
| 1,188,377 | 6/1916 | Weaver | 280/11.19 |
| 2,159,974 | 5/1939 | Lohr | 446/279 |
| 2,841,408 | 7/1958 | Mariotte | 280/38 |
| 3,046,032 | 7/1962 | Humphries | 280/11.19 |
| 3,086,787 | 4/1963 | Wyche | 280/11.19 |
| 3,414,280 | 12/1968 | Ohashi | 280/11.19 |
| 3,649,038 | 3/1972 | Huckenbeck | 280/11.28 |
| 3,891,228 | 6/1975 | Rhinehart et al. | 280/36 |
| 3,901,520 | 8/1975 | McMahan | 280/11.19 X |
| 3,964,762 | 6/1976 | Adams | 280/439 |
| 4,393,620 | 7/1983 | Murakami | 446/470 X |
| 4,718,875 | 1/1988 | McKittrick et al. | 446/231 |
| 4,810,229 | 3/1989 | Shoji | 446/443 |
| 4,850,929 | 7/1989 | Genevey | 446/466 |
| 5,295,701 | 3/1994 | Reiber et al. | 280/11.22 |
| 5,372,534 | 12/1994 | Levy et al. | 280/11.22 X |

FOREIGN PATENT DOCUMENTS

| | | | |
|---|---|---|---|
| 11025 | 6/1904 | United Kingdom | 180/906 |

*Primary Examiner*—Mickey Yu
*Attorney, Agent, or Firm*—Nixon & Vanderhye

[57] ABSTRACT

Each roller skate includes front and rear pairs of wheels longitudinally spaced from one another and carried by a frame for rotation about longitudinally spaced axes in a first configuration of the roller skate. A parallelogram linkage connects the wheels and the frame. By displacing the linkage, the wheels are movable into a second configuration wherein the wheels are in-line one behind the other and rotatable about transverse axes longitudinally spaced from one another. The wheels may be locked in the first configuration and biased for movement into the second configuration. Alternatively, the wheels may be locked in both configurations by a combined brake pad and locking assembly.

14 Claims, 5 Drawing Sheets

29
35
12
34
27
26
30
28
24
33
32
22
30
18r
16r
33
32
20
18L
16L
14r
14L

VARIABLE GEOMETRY ROLLER SKATES

RELATED APPLICATIONS

This application is a continuation-in-part of application Ser. No. 07/986,564, filed Dec. 7, 1992, U.S. Pat. No. 5,372,534 for Variable Geometry Conveyance, the disclosure of which application is incorporated herein by reference.

BACKGROUND AND SUMMARY OF THE INVENTION

The present invention relates to variable geometry roller skates having the capability to transform between first and second wheeled configurations, and particularly between a first configuration having forward and rear pairs of wheels on respective common axes spaced longitudinally from one another and a second configuration having the wheels substantially in-line one behind the other in a longitudinal direction.

In the present description, the invention is described in relation to roller skates, although it will be appreciated that the invention is more broadly applicable to conveyances in general, including vehicles such as automobiles or trucks; skateboards; toy vehicles and the like, similarly as set forth in the above-identified patent application. In a preferred embodiment hereof, there is provided a pair of roller skates wherein each roller skate has four wheels displaceable between a first configuration wherein front and rear pairs of wheels are arranged in a typical four-wheel orientation, and a configuration wherein the wheels lie in tandem or in-line configuration with the axes of the wheels transversely parallel to and non-coincident with one another. The term "in-line," "tandem" or "second" configuration thus embraces within its meaning a configuration wherein all wheels are in substantial longitudinal alignment one with the other, i.e., a zero track. It will also be appreciated that each of the roller skates hereof, at a minimum, has at least three wheels with at least two of the wheels longitudinally spaced from one another defining longitudinally spaced axes in the first configuration and two wheels having transverse axes longitudinally spaced from one another and all wheels having axes non-coincident with one another in a second configuration. Hence, the roller skate may include a tricycle roller skate configuration with three wheels in a typical tricycle configuration.

In accordance with a preferred embodiment of the present invention, each of the roller skates hereof may be transformed or converted between a first configuration with front and rear wheels on longitudinally spaced axes, e.g., a front wheel and a pair of rear wheels (tricycle configuration) or more typically front and rear pairs of wheels, and a second configuration, wherein the wheels are in-line or tandem. The transformation from one configuration to the other may be accomplished manually, with the wheels being releasably locked and unlocked in each configuration for use in that configuration and unlocked for displacement toward and locking in the other configuration. Alternatively, the transformation from one configuration to the other may be powered, for example, by employing a spring which biases the wheels for movement from one configuration toward the other configuration. For example, a wheel assembly may be locked in a standard four-wheel configuration with a spring biasing the wheel assembly for movement of the wheels into the second configuration. By manually unlocking the wheels in the four-wheel configuration, the wheel assembly under the bias of the spring may be displaced toward and into the second configuration. The wheels in the second configuration, of course, may be returned to the first configuration manually.

In a preferred embodiment, each roller skate includes a frame or platform, pairs of front and rear wheels, and a connection or mechanism between the frame or platform and the wheels enabling transformation of the roller skate from the four-wheel configuration into the tandem wheel configuration. The transformation mechanism may take the form of a parallelogram linkage, i.e., a pair of longitudinally extending, transversely spaced side frame elements interconnected adjacent their ends by longitudinally spaced, transversely extending end or cross-link elements. The front and rear wheels are connected to this linkage adjacent the pivots of the linkage and each wheel is mounted for rotation about an axis independent of the axis of any other wheel. The cross-links are pivotally coupled to the platform or frame.

The platform or frame may comprise a sole plate having heel and toe portions for receiving an individual's shoe or sneaker as well as straps for securing the individual's shoe or sneaker to the sole plate. Alternatively, the platform or frame may comprise the sole of a shoe customized for roller skating. In either case, shafts, roller plates with bearings, or equivalent structure interconnect the cross-links and the frame or platform forming a structural coupling between the wheels and the sole plate.

In a preferred embodiment according to the present invention, there is provided a variable geometry roller skate comprising a frame, front and rear pairs of wheels carried by the frame and longitudinally spaced from one another for rotation about longitudinally spaced, transversely extending, generally parallel front and rear axes, respectively, in a first configuration enabling the roller skate for movement in a longitudinal direction and means connecting the frame and the front and rear pairs of wheels for enabling displacement of the wheels from the first configuration to a second configuration without disassembly of the wheels relative to the frame, each wheel in the second configuration being rotatable about a discrete, transversely extending axis spaced longitudinally of the axis of each other wheel of the front and rear pairs of wheels, enabling the roller skate for movement in the longitudinal direction, the connecting means enabling the wheels of the front and rear pairs of wheels to lie in substantial longitudinal alignment with one another in the second configuration, whereby all wheels of the pairs thereof lie substantially in-line with one another in the second configuration.

In a further preferred embodiment according to the present invention, there is provided a variable geometry roller skate comprising a frame, front and rear pairs of wheels, means connecting the front and rear pairs of wheels and the frame establishing first and second configurations of the wheels, the pairs of front and rear wheels in the first configuration being longitudinally spaced from one another for rotation about longitudinally spaced, transversely extending front and rear axes, respectively, enabling the roller skate for movement in a longitudinal direction, each wheel of the front and rear pairs of wheels in the second configuration being rotatable about a discrete transversely extending axis spaced longitudinally of the axis of each other wheel of the front and rear pairs of wheels and lying in substantial longitudinal alignment with each other wheel of the front and rear pairs of wheels whereby all wheels of the pairs thereof lie substantially in-line with one another in the second configuration, enabling the roller skate for movement in the longitudinal direction, the connecting means enabling displacement of the wheels from one of the first and second configurations to another of the first and second configurations without disassembly of the wheels relative to the frame.

In a still further preferred embodiment according to the present invention, there is provided a variable geometry roller skate comprising a frame, a pair of wheels and at least a third wheel carried by the frame, the pair of wheels and the third wheel being longitudinally spaced from one another for rotation about longitudinally spaced, transversely extending axes, respectively, in a first configuration of the wheels, enabling the roller skate for movement in a longitudinal direction, means connecting the frame and the pair of wheels for enabling displacement of the pair of wheels from a first orientation in the first configuration of the wheels to a second orientation in a second configuration of the wheels wherein each wheel of the pair of wheels and the third wheel is rotatable about a discrete transversely extending axis spaced longitudinally of the axis of each other wheel thereof, enabling the roller skate for movement in the longitudinal direction in the second configuration, the connecting means enabling the wheels of the pair of wheels without disassembly of the pair of wheels relative to the frame to lie in substantial longitudinal alignment with one another and with the third wheel in the second configuration whereby all wheels of the pair of wheels and the third wheel lie substantially in-line with one another in the second configuration.

Accordingly, it is a primary object of the present invention to provide novel and improved variable geometry roller skates which may be transformed between different wheeled configurations and particularly, in a preferred embodiment, may be transformed between a standard four-wheel skate configuration with front and rear pairs of wheels on respective longitudinally spaced axes and a configuration with the wheels substantially in-line with one another in a longitudinal direction.

These and further objects and advantages of the present invention will become more apparent upon reference to the following specification, appended claims and drawings.

DETAILED DESCRIPTION OF THE DRAWINGS

Reference will now be made in detail to a present preferred embodiment of the invention, an example of which is illustrated in the accompanying drawings.

Figure 1:
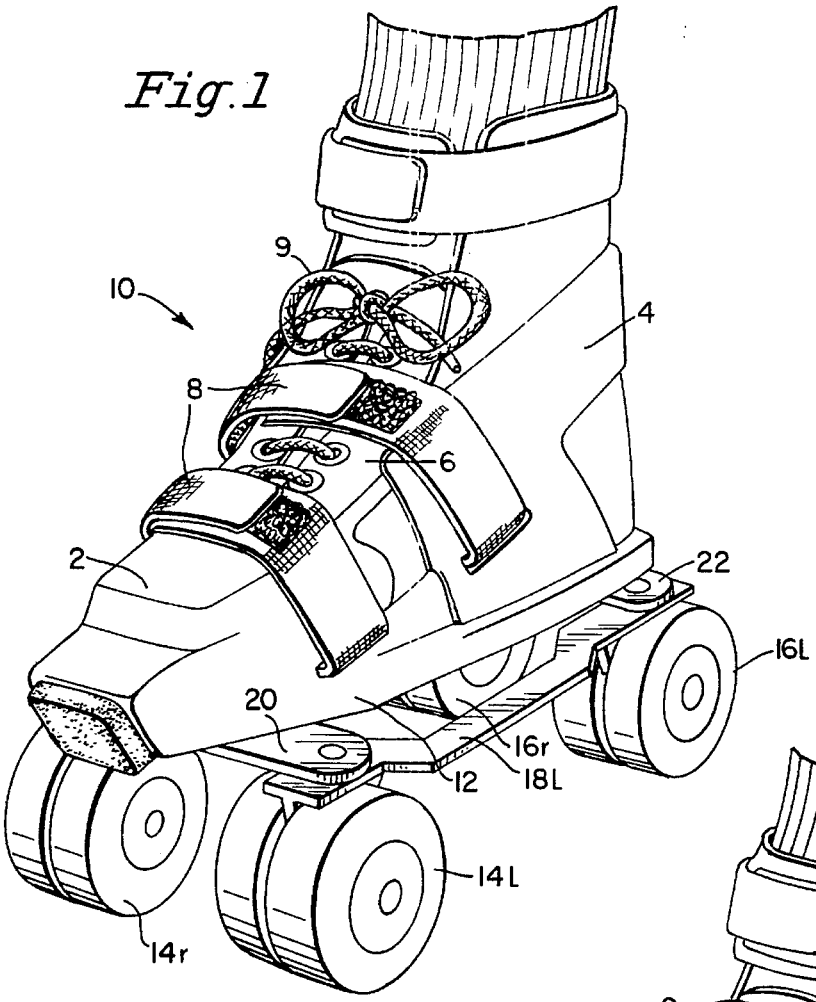
FIGS. 1 and 2 are perspective views of a roller skate in first and second configurations, respectively, according to a preferred embodiment of the present invention.
Figure 2:
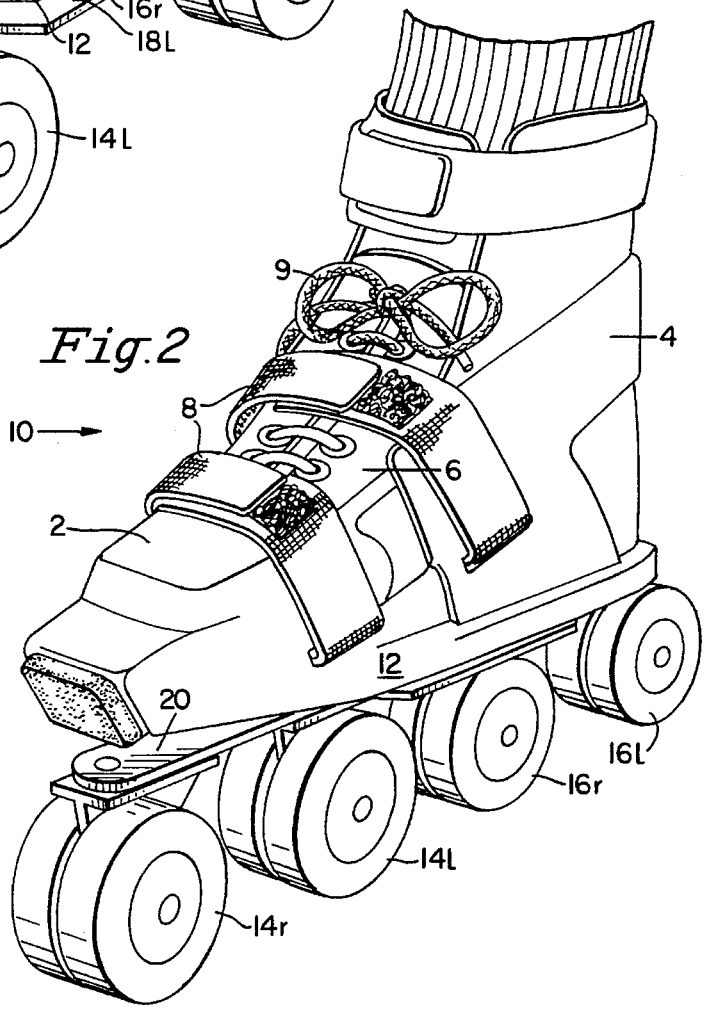
Figure 9:
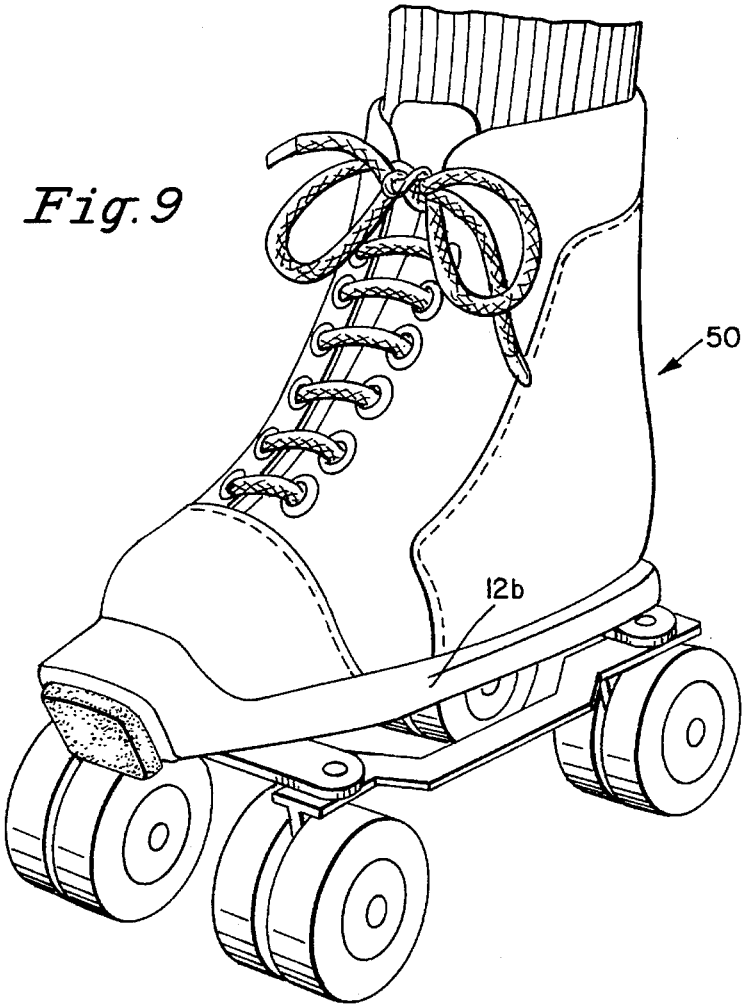
FIG. 9 is a perspective view of a roller skate illustrating the platform or frame comprising the sole plate of a shoe customized for roller skating.

Referring now to FIGS. 1 and 2, there is illustrated and in a preferred embodiment, a variable geometry roller skate, generally designated 10, it being appreciated that a pair of such roller skates are typically provided. In FIG. 1, the left roller skate is illustrated and in a first configuration, with the wheels of the roller skate arranged typically in front and rear pairs thereof. In contrast, in FIG. 2, the same roller skate is illustrated in a second or in-line configuration, with the four wheels of the roller skate lying substantially in-line one behind the other in the longitudinal direction. In the illustrated arrangement, a platform or main frame 12 constitutes a sole plate which may either receive the user's shoe or sneaker, as illustrated in FIGS. 1 and 2, or may constitute an integral portion of a shoe customized for roller skating, as illustrated in FIG. 9. In the illustrative example of FIGS. 1 and 2, the sole plate mounts toe and heel portions 2 and 4, respectively, for receiving the user's shoe 6. Preferably, the toe and heel portions 2 and 4 each carry straps 8 or laces 9, or both, for securing the shoe 6 to the sole plate.

Figure 3:
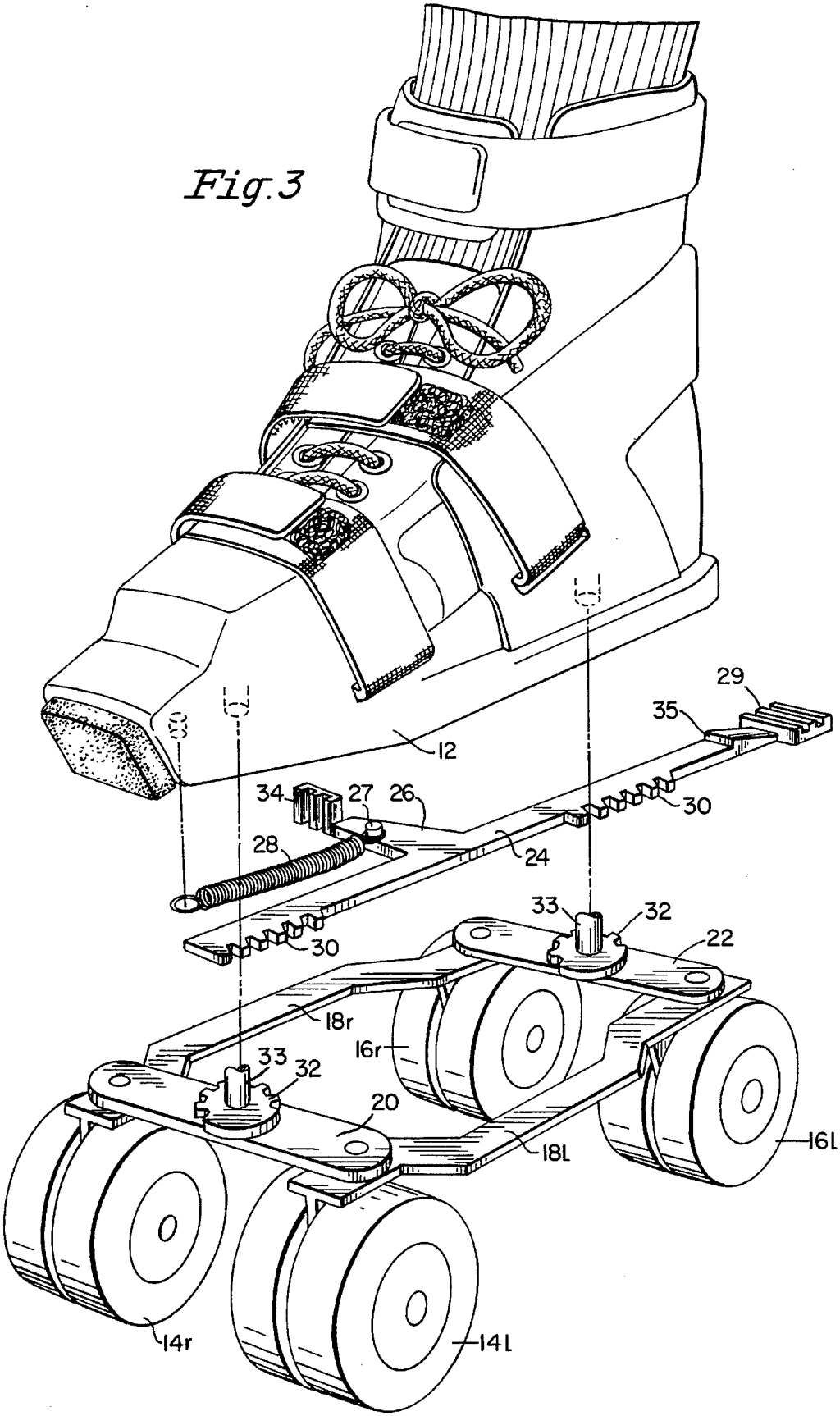
FIG. 3 is a schematic perspective view with parts in exploded juxtaposition illustrating a roller skate in the first configuration and the mechanism for transformation between the first and second configurations.

Referring to FIG. 3, the platform or frame constituting sole plate 12 mounts front and rear pairs of wheels 14 and 16, respectively. The axis of each pair of wheels extends transversely and is longitudinally spaced from the transverse axis of the other pair of wheels. As indicated previously, the first configuration may embrace at least three wheels, e.g., a tricycle configuration. Thus, at least two of the wheels in the first configuration of a roller skate having a tricycle configuration has axes longitudinally spaced from one another, e.g., a single front wheel and a pair of rear wheels, or vice versa, the pair of wheels having a common transverse axis spaced longitudinally from the axis of the single wheel. The pairs of wheels of the roller skate having the standard four-wheel configuration and the pair of wheels of the roller skate having three wheels in a tricycle configuration establish a predetermined track when the roller skate is in its first configuration.

In FIG. 2, the roller skate 10 of FIG. 1 is illustrated in an in-line, tandem or second configuration. In this configuration, the wheels of the vehicle have been transformed from the first configuration of FIG. 1 into the second configuration of FIG. 2, wherein the transverse axis of each wheel is longitudinally spaced from the transverse axis of every other wheel and with a track less than the predetermined track of the wheels in the first configuration. In the specific embodiment illustrated, the four wheels have been transformed from the illustrated conventional four-wheel configuration of the roller skate of FIG. 1 into an in-line configuration of the roller skate in FIG. 2, with the transverse axes of rotation of the wheels lying generally parallel to and longitudinally spaced one from the other and with the wheels longitudinally behind one another. That is, in this specific embodiment of the second configuration, the wheels lie in a common longitudinal plane in the direction of travel and, hence, have a zero track. In this specific embodiment also, the front wheels have been transformed such that the right front wheel **14*r* in the first roller skate configuration of FIG. 1 is located in front of the left front wheel 14*l* of the pair of front wheels in the second configuration. Similarly, the pair of rear wheels has been transformed from the configuration of FIG. 1 such that the right wheel 16*r* is longitudinally spaced in front of the left wheel 16*l*** in the second configuration.

Figure 3A:
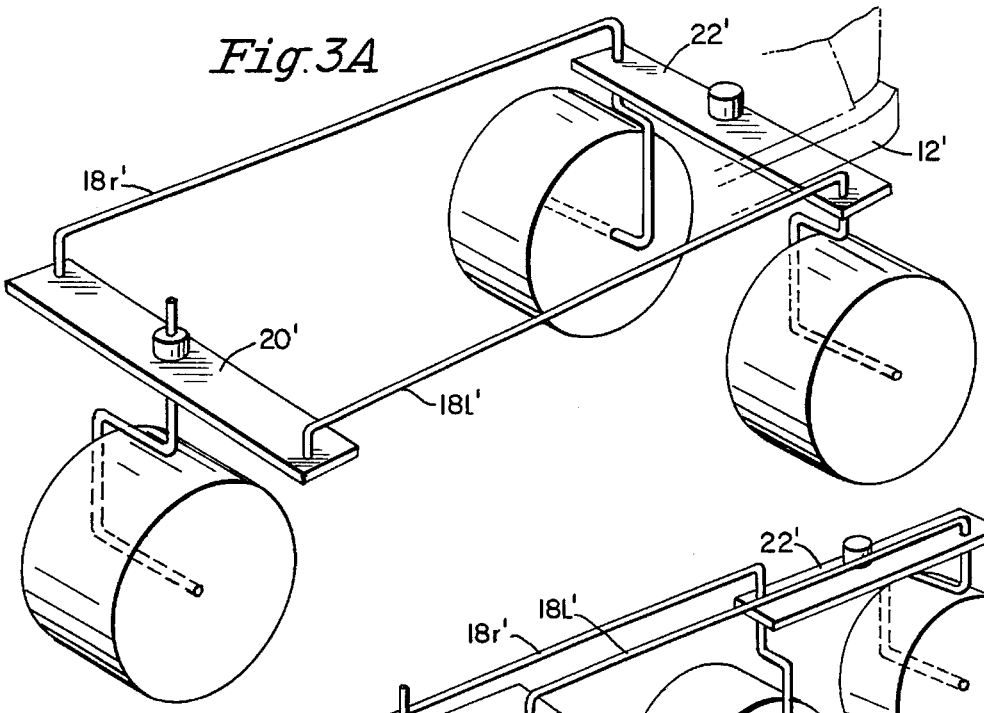
FIGS. 3A and 3B are schematic perspective views illustrating a roller skate in a first tricycle configuration and a second transformed inline configuration, respectively.

In a tricycle configuration, the single front or back wheel would remain in position in both configurations, while the pair of back or front wheels, respectively, would move to an in-line position wherein the axes of all wheels are generally transversely parallel and longitudinally spaced relative to one another. This is illustrated in FIG. 3A. It will be appreciated from a review of FIGS. 1–5 that the roller skate is movable in a generally longitudinal direction in both the first and second configurations of the roller skate.

Figure 4:
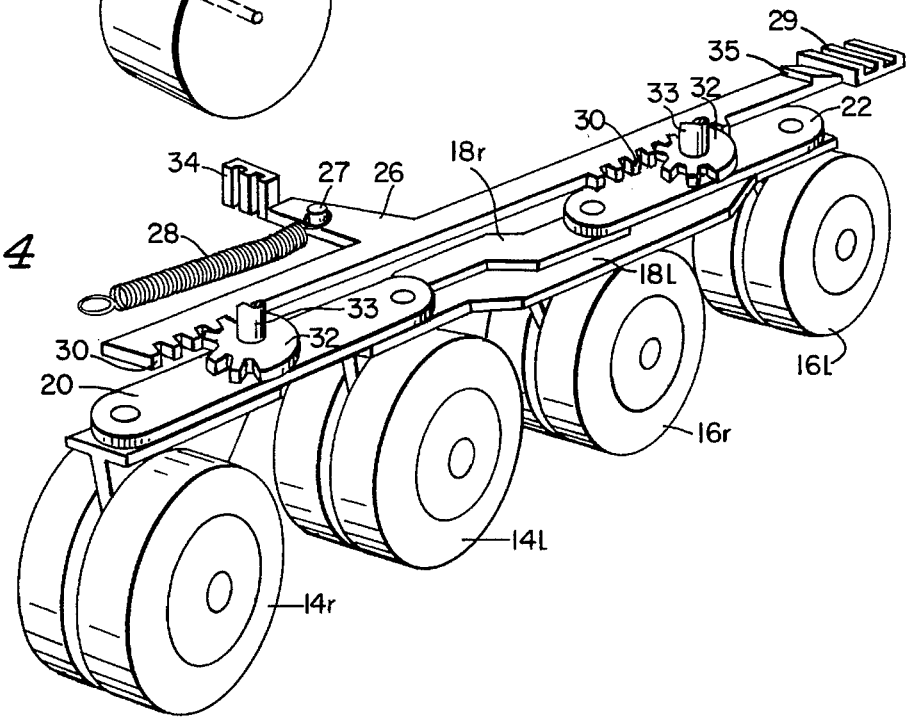
FIG. 4 is a perspective view illustrating the transformation mechanism of the roller skate in a second in-line position.

Referring specifically to FIGS. 3 and 4, means are provided connecting between the frame or platform 12 and the front and rear wheels 14 and 16 for effecting a transformation of the roller skate from one configuration to the other and back and include a parallelogram-type linkage. For example, left and right chassis or frame elements 18*r* and 18*l*, respectively, pivotally connect at opposite ends with front and rear cross-links 20 and 22, respectively. The front and rear cross-links are suitably pivotally connected by shafts, roller plates, bearings or the like to the frame or platform 12 constituting the sole plate to enable movement of the linkage between the orthogonal parallelogram linkage configuration of FIG. 3 and the non-orthogonal parallelogram linkage of FIG. 4. By displacing the linkage between the two configurations, two different modes of use of the roller skate are obtained.

Means are provided connecting between the platform or frame 12 and the parallelogram linkage coupled to the wheels for positively displacing the wheels between the first and second configurations. The positive displacing means may comprise, for example, in a preferred embodiment, a rack shuttle 24 suitably secured to the frame 12, e.g., by tracks, enabling the shuttle for longitudinal movement. Rack shuttle 24 has a laterally projecting arm 26, and a pin 27 upstands from the arm 26 for connection to one end of a coil spring 28. The opposite end of spring 28 is connected to the underside of the frame or platform 12. Linear extending gear teeth 30 are provided adjacent opposite ends of rack shuttle 24 and engage gears 32 fixed at medial locations to the front and rear cross-links 20 and 22, respectively. Consequently, by displacing rack shuttle 24 longitudinally of frame or platform 12, for example, in a forward direction, cross-links 20 and 22 are pivoted about spaced vertical axes passing through the center of the gears 32 to transform the roller skate from the first configuration of FIG. 1 to the second configuration of FIG. 2. The positive displacement means, for example, for transforming the roller skate from the first to the second configurations may include the coil spring 28 which biases the rack shuttle 24 for movement in a forward direction, tending to rotate the cross-links in a direction to move wheels 14 and 16 into the in-line or second configuration illustrated in FIG. 4. It will be appreciated that the rack shuttle can be displaced in the opposite direction to return the wheels from the in-line configuration illustrated in FIG. 4 to the standard four-wheel configuration illustrated in FIG. 3 by manually displacing the shuttle rack 24 in a rearward direction, for example, by grasping the tab 29 at the end of the rack shuttle 24. In the preferred embodiment hereof, a pair of shafts 33 connect the gears 32 and the frame or platform 12 to one another for supporting the frame or platform 12 on the transformation mechanism. For structural support, the shafts can be thickened up or enlarged to form plates having roller bearings between the plates secured to the gears 32 and the underside of the frame or platform 12, respectively.

Figure 3B:
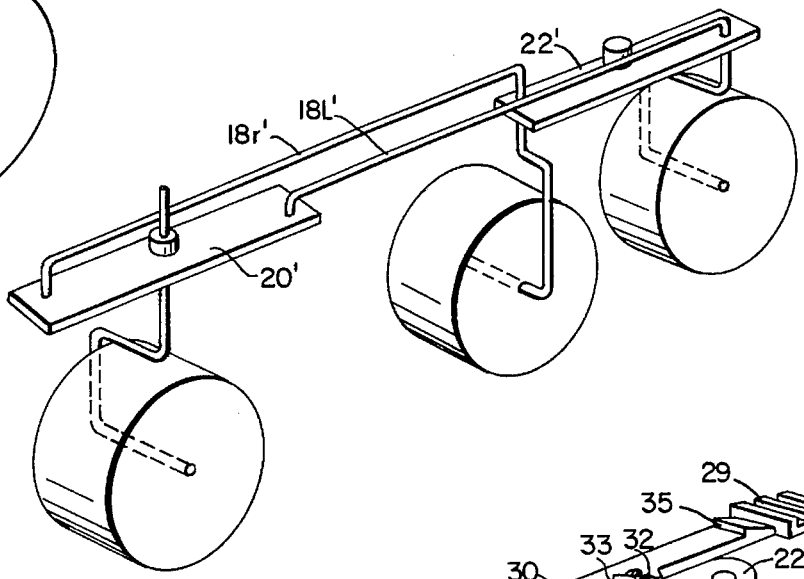

In the tricycle configuration illustrated in FIG. 3A, the forward wheel is mounted on the centerline of the frame 12'. It will be appreciated that the crosslinks 20' and 22' are pivotally carried by the frame. Consequently, when the crosslinks are pivoted by the parallelogram linkage 18*r*' and 18*l*' illustrated in FIG. 3A into the non-orthogonal parallelogram linkage, as illustrated in FIG. 3B, a substantial longitudinal alignment of the rear wheels and front wheel is obtained.

Referring to FIGS. 4–7, a locking or latch mechanism is provided for locking the platform or frame 12 and the transformation mechanism in the first configuration. For example, in FIG. 4, the tab 29 has a forwardly directed edge 35 which lies in longitudinal alignment with the heel of the sole plate. With the wheels of the skate in the first configuration, as illustrated in FIG. 3, edge 35 engages the heel to prevent the bias of spring 28 from displacing the rack shuttle 24 forwardly, thereby preventing transformation of the mechanism from the first to the second configurations. In this embodiment, manual downward pressure on tab 29 displaces edge 35 from engagement with the heel, enabling the bias of spring 28 to displace the rack shuttle 24 forwardly, transforming the roller skate from the first configuration to its second configuration illustrated in FIG. 4. Spring 28 maintains the wheels in the in-line position. To return wheels from the in-line configuration to the standard four-wheel configuration illustrated in FIG. 3, a tab 34 carried on the end of arm 26 may be manually displaced rearwardly, displacing the rack shuttle rearwardly to locate edge 35 just behind the heel. The flexing action of the rear end of the rack shuttle permits the edge 35 to engage the heel to lock the transformation mechanism in the first configuration.

Figure 5:
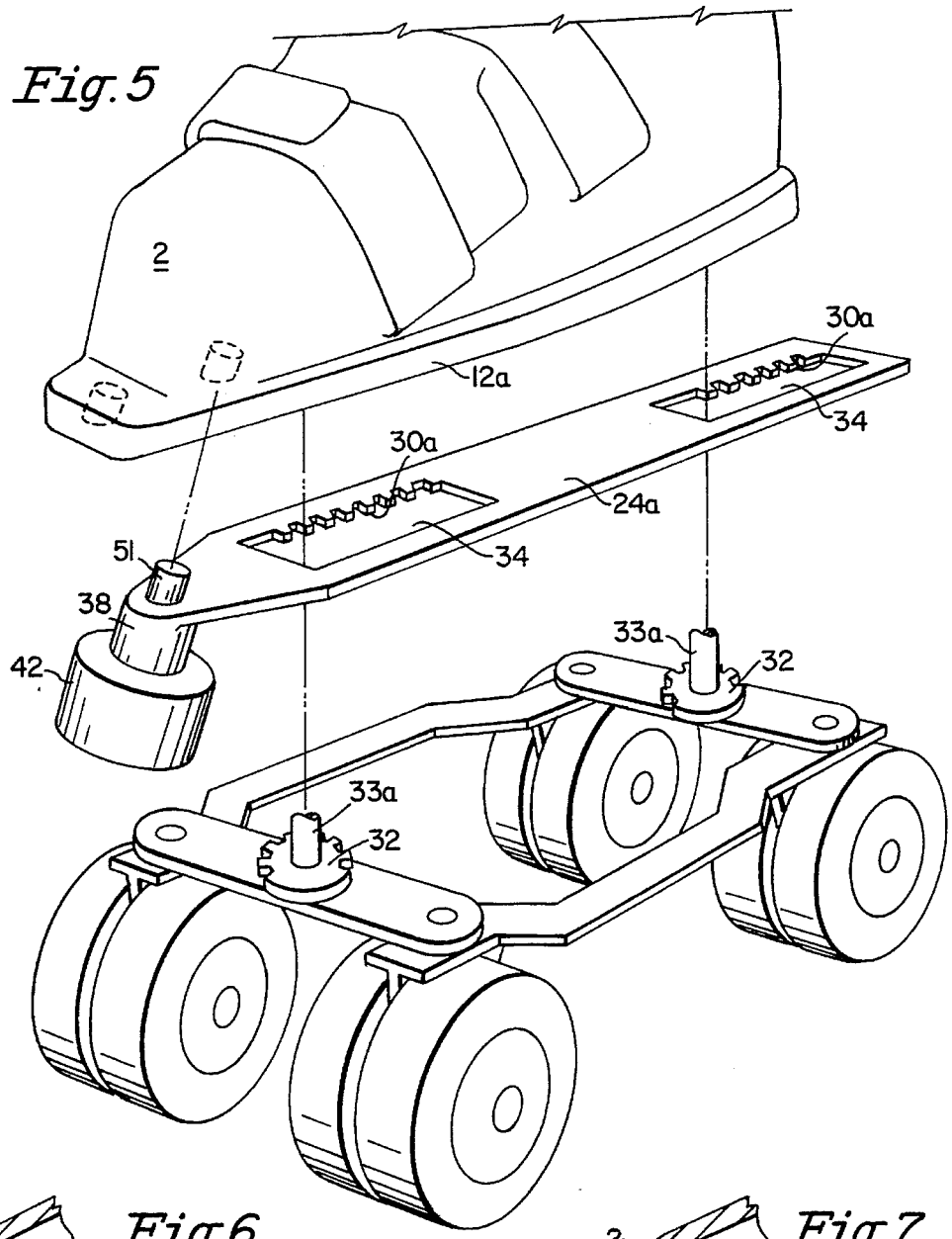
FIG. 5 is a view similar to FIG. 3 illustrating a further form of the transformation mechanism.
Figure 6:
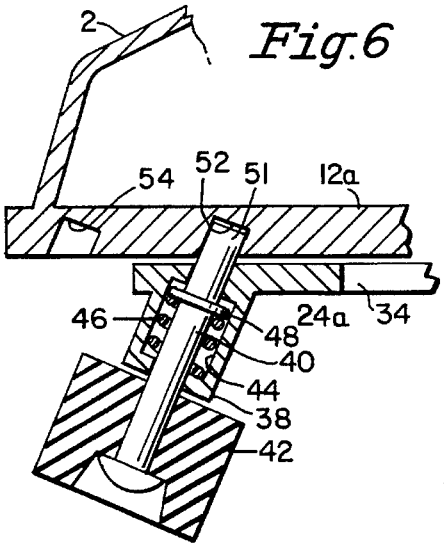
FIGS. 6 and 7 are fragmentary enlarged cross-sectional views illustrating a combined safety lock and brake pad in two positions, respectively, relative to the sole plate.
Figure 7:
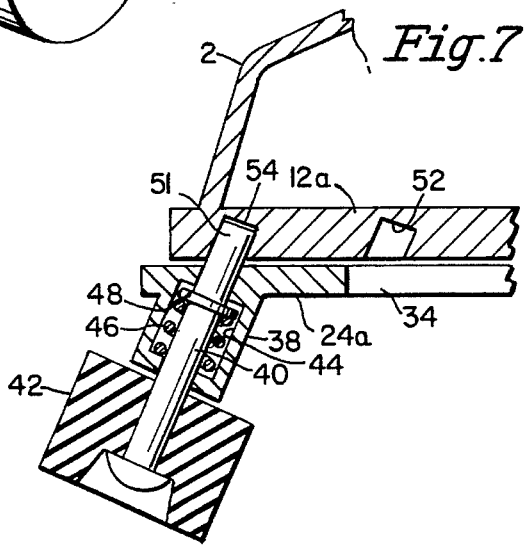

In FIGS. 5–7, there is illustrated another embodiment of a locking or latching mechanism which is combined with a brake pad. In this configuration, the rack shuttle 24*a* has a substantial width to define slots 34 adjacent its forward and rearward ends. One linear edge of each of the slots 34 carries gear teeth 30*a* for engagement with the gear teeth 32 of the cross-links. The shafts 33*a* connecting the transformation mechanism with the frame or platform 12*a* also pass through the openings 34. Thus, it will be appreciated that by displacing the rack shuttle 24*a* forwardly from its position illustrated in FIG. 5, the roller skate may be transformed from the first configuration illustrated in FIG. 5 to the second configuration. Similarly, a rearward displacement of the rack shuttle 24*a* causes the roller skate to transform from the second in-line configuration to the standard four-wheel configuration illustrated in FIG. 5.

To lock the transformation mechanism in either the first or second configuration, there is provided a downwardly and forwardly extending projection 38 depending from the forward tip of the rack shuttle 24*a*. A pin 40 extends through the projection 38, terminating at its lower end in a knob or brake pad 42. Within the chamber 44 of projection 38, a coil spring 46 bears against and therefore biases a flange 48 carried by pin 40 such that, in the normal position of pin 40, its distal end 50 projects above the upper surface of rack shuttle 24*a*. As illustrated, the toe portion 2 of the roller skate is apertured at longitudinally spaced locations 52 and 54 along the sole plate or platform 12*a*. When the transformation mechanism lies in the first wheel configuration illustrated in FIG. 5, the distal end 50 of pin 40 is biased into the rear recess 52, locking the rack shuttle 24*a* relative to frame or platform 12. When it is desired to transform the roller skate from the first configuration to the second configuration, the knob or brake pad 42 is grasped and pulled downwardly and outwardly to withdraw the tip 51 of pin 40 from recess 52. The rack shuttle may then be manually advanced relative to the platform or frame 12 to locate the pin in alignment with the forward recess 54 whereupon, release of the pin enables the spring 46 to engage the tip 51 in recess 54, locking the rack shuttle in its forwardmost position with the wheels in the second configuration. It will be appreciated that a spring arrangement similar to spring 28 may be employed between the platform or frame 12*a* and rack shuttle 24*a* to bias the rack shuttle for movement in a forward direction, i.e., in a direction transforming the roller skate from the first configuration into the second configuration, similarly as illustrated in FIGS. 3 and 4.

It will be appreciated that when the transformation mechanism lies in the second configuration, the brake pad 42 lies forwardly of the forwardmost wheel 14*r*. Consequently, the skate may be tilted or inclined when in the in-line position to drag the brake pad 42 along the ground whereby it serves as a brake. Similarly, when the transformation mechanism lies in the first configuration, the brake pad 42 projects forwardly of the forwardmost pair of wheels 14 so that it may similarly be used as a brake. It will be appreciated that the brake pad may be disposed at the rear end of the roller skate and need not necessarily be combined with the locking mechanism. That is, the locking mechanism may comprise a smaller spring biased knob at the forward part of the roller skate which does not serve as a brake pad, while the brake pad can be disposed on an extended rear portion of the rack shuttle or from the sole plate whereby braking action can be obtained from the rear of the roller skate.

Figure 8:
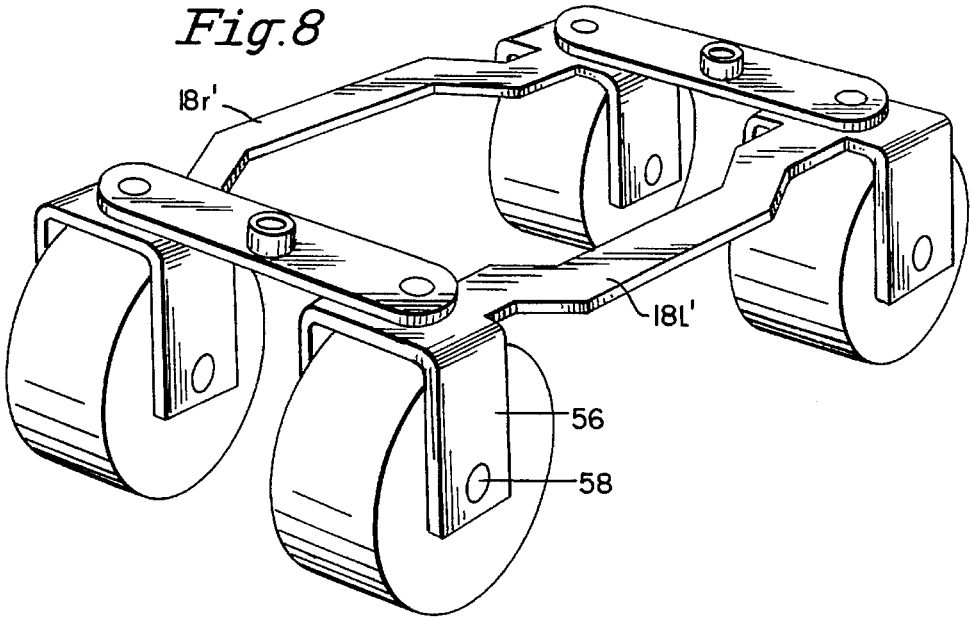
FIG. 8 is a perspective view of a further embodiment of the transformation mechanism hereof.

Referring now to FIG. 8, there is illustrated a further form of transformation mechanism wherein the left and right chassis elements 18*l*' and 18*r*' terminate at their forward and rear ends in generally downwardly directed U-shaped members 42 forming caster-type supports for the wheels. In this form, the legs of each downwardly extending U-shaped member mounts an axle 44 for supporting the associated wheel.

In FIG. 9, the platform 12*b* forms an integral part of a shoe or boot 50 customized for roller skating. The upper of the shoe 50 is thus secured directly to the platform 12*b* which also mounts the transformation mechanism.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A variable geometry roller skate comprising:

a frame;

front and rear pairs of wheels carried by said frame and longitudinally spaced from one another for rotation about longitudinally spaced, transversely extending, generally parallel front and rear axes, respectively, in a first configuration enabling the roller skate for movement in a longitudinal direction; and means connecting said frame and said front and rear pairs of wheels for enabling displacement of said wheels from said first configuration to a second configuration without disassembly of said wheels relative to said frame, each wheel in said second configuration being rotatable about a discrete, transversely extending axis spaced longitudinally of the axis of each other wheel of said front and rear pairs of wheels, enabling the roller skate for movement in said longitudinal direction, said connecting means enabling the wheels of said front and rear pairs of wheels to lie in substantial longitudinal alignment with one another in said second configuration, whereby all wheels of said pairs thereof lie substantially in-line with one another in said second configuration.

2. A roller skate according to claim 1 wherein said connecting means includes, in said first configuration of said wheels, generally longitudinally extending, transversely spaced, side elements and generally transversely extending, longitudinally spaced, end elements pivoted to one another to form a generally parallelogram linkage, and means interconnecting said frame and one of said elements for pivoting said linkage from a generally orthogonal rectilinear configuration establishing said first configuration to a non-orthogonal rectilinear configuration establishing said second configuration.

3. A roller skate according to claim 2 wherein one of said end elements is rotatable about a generally vertical axis normal to said longitudinal and transverse directions, and drive means cooperable between said frame and said one end element for rotating said one end element about said vertical axis to pivot said linkage and displace said wheels from said first configuration toward said second configuration.

4. A roller skate according to claim 1 wherein said connecting means enables displacement of said wheels from said second configuration to said first configuration.

5. A roller skate according to claim 1 wherein said connecting means includes means for positively displacing said wheels from said first configuration toward said second configuration.

6. A roller skate according to claim 1 including a latch cooperable between said frame and said connecting means for releasably locking said wheels in at least one of said configurations.

7. A roller skate according to claim 6 including a brake pad carried by said latch.

8. A roller skate according to claim 1 including a latch cooperable between said frame and said connecting means for releasably locking said wheels in each of said first and second configurations.

9. A variable geometry roller skate comprising:

a frame;

front and rear pairs of wheels;

means connecting said front and rear pairs of wheels and said frame establishing first and second configurations of said wheels, said pairs of front and rear wheels in said first configuration being longitudinally spaced from one another for rotation about longitudinally spaced, transversely extending front and rear axes, respectively, enabling the roller skate for movement in a longitudinal direction, each wheel of said front and rear pairs of wheels in said second configuration being rotatable about a discrete transversely extending axis spaced longitudinally of the axis of each other wheel of said front and rear pairs of wheels and lying in substantial longitudinal alignment with each other wheel of said front and rear pairs of wheels whereby all wheels of said pairs thereof lie substantially in-line with one another in said second configuration, enabling the roller skate for movement in said longitudinal direction;

said connecting means enabling displacement of said wheels from one of said first and second configurations to another of said first and second configurations without disassembly of said wheels relative to said frame.

10. A roller skate according to claim 9 wherein said connecting means includes in said first configuration of said wheels, generally longitudinally extending, transversely spaced, side elements and generally transversely extending, longitudinally spaced end elements pivoted to one another to form a generally parallelogram linkage, and means interconnecting said frame and one of said elements for pivoting said linkage from a generally orthogonal rectilinear configuration establishing said first configuration to a non-orthogonal rectilinear configuration establishing said second configuration.

11. A roller skate according to claim 9 including a latch cooperable between said frame and said connecting means for releasably locking said wheels in at least one of said configurations.

12. A roller skate according to claim 11 including a brake pad carried by said latch.

13. A roller skate according to claim 9 including a latch cooperable between said frame and said connecting means for releasably locking said wheels in each of said first and second configurations.

14. A variable geometry roller skate comprising:

a frame;

a pair of wheels and at least a third wheel carried by said frame, said pair of wheels and said third wheel being longitudinally spaced from one another for rotation about longitudinally spaced, transversely extending axes, respectively, in a first configuration of said wheels, enabling the roller skate for movement in a longitudinal direction;

means connecting said frame and said pair of wheels for enabling displacement of said pair of wheels from a first orientation in said first configuration of said wheels to a second orientation in a second configuration of said wheels wherein each wheel of said pair of wheels and said third wheel is rotatable about a discrete transversely extending axis spaced longitudinally of the axis of each other wheel thereof, enabling the roller skate for movement in said longitudinal direction in said second configuration;

said connecting means enabling the wheels of said pair of wheels without disassembly of said pair of wheels relative to said frame to lie in substantial longitudinal alignment with one another and with said third wheel in said second configuration whereby all wheels of said pair of wheels and said third wheel lie substantially in-line with one another in said second configuration.

* * * * *